US005546740A

United States Patent [19]

Dinkelmann et al.

[11] Patent Number: 5,546,740

[45] Date of Patent: Aug. 20, 1996

[54] ACTUATING LINKAGE FOR BOBBIN CHANGER

[75] Inventors: Friedrich Dinkelmann, Maltis; Dieter Vetter, Ebersbach/Fils; Manfred Samp, Diezisau, all of Germany

[73] Assignee: Zinser Textilmaschinen GmbH, Ebersbach/Fils, Germany

[21] Appl. No.: 510,464

[22] Filed: Aug. 2, 1995

[30] Foreign Application Priority Data

Aug. 12, 1994 [DE] Germany ..... 44 28 665.1

[51] Int. Cl.[6] ..... D01H 9/00; D01H 9/04

[52] U.S. Cl. ..... 57/266; 57/75; 57/90; 57/274; 57/276; 57/281

[58] Field of Search ..... 57/276, 277, 274, 57/281, 90, 266

[56] References Cited

U.S. PATENT DOCUMENTS

| | | | |
|---|---|---|---|
| 3,550,368 | 12/1970 | Marenco | 57/274 |
| 3,793,818 | 2/1974 | Yamamoto | 57/274 |
| 3,823,538 | 7/1974 | Igel | 57/274 |
| 4,014,161 | 3/1977 | Cox | 57/274 |
| 4,294,067 | 10/1981 | Takahisa et al. | 57/274 |
| 5,125,224 | 6/1992 | Klaus | 57/276 |
| 5,373,689 | 12/1994 | Maeser et al. | 57/90 |

FOREIGN PATENT DOCUMENTS

| | | | |
|---|---|---|---|
| 1785217 | 8/1971 | Germany . | |
| 4210494 | 10/1993 | Germany . | |
| 2061117 | 3/1990 | Japan | 57/281 |

*Primary Examiner*—Daniel P. Stodola
*Assistant Examiner*—William Stryjewski
*Attorney, Agent, or Firm*—Herbert Dubno; Andrew Wilford

[57] ABSTRACT

In a ring-spinning machine having a frame and a spindle bank holding a row of bobbins, a bobbin-changing apparatus has a gripper beam engageable with the bobbins of the spindle banks and movable between an upper and a lower position and a scissor linkage pivoted on the frame and on the gripper beam extendable for raising the beam and collapsible for lowering the beam. The linkage has a pair of arms both of which have lower ends, one of which is long and has an upper end pivoted on the beam and the other of which is short and has an upper end pivoted on the long arm below the beam. One of the lower ends is pivoted on and fixed against longitudinal movement on an abutment. A guide is longitudinally displaceable on the frame and the other lower end is pivoted on it. A spring-biasing unit exerts torque on one of the ends of one of the arms for upwardly biasing the beam at least in the lower position of the beam.

14 Claims, 5 Drawing Sheets

ACTUATING LINKAGE FOR BOBBIN CHANGER

FIELD OF THE INVENTION

The present invention relates to an actuating linkage. More particularly this invention concerns such a linkage that displaces the bobbin-changing apparatus of a spinning or twisting machine.

BACKGROUND OF THE INVENTION

A two-sided ring-spinning machine with a bobbin-changing apparatus for simultaneously changing full bobbins for empty ones on both sides of the machine has a pair of gripper beams each moved by a respective push/pull member via a respective scissor linkage to grab the full and empty bobbins on each side of the machine.

In order to be able to move this gripper beam in and out and up and down as is necessary for changing the bobbins, each beam is held on a scissor linkage which is pivoted about a shaft in the lower region of the spinning machine or is mounted in a traveling slide. The drive for up-and-down movement of the gripper beam is effected by longitudinal movement of the shaft as described in European patent publication 0,445,375 of W. Klaus or a pull rod mounted in the slide as described in German 2,045,263 or by pulling members as described in German 1,785,217 on the scissor linkage. Electric motors and shaft drives as described in European patent publication 0,445,374 or fluid-powered drive elements as described in above-mentioned German 2,045,263 are used to power the push/pull element.

In commonly owned patent 5,373,689 issued 20 Dec. 1994 a two-sided ring-spinning machine is described having a frame and a pair of parallel spindle banks each holding a respective row of bobbins. A bobbin-changing apparatus has respective gripper beams engageable with the bobbins of the spindle banks, respective scissor linkages pivoted on the frame and on the gripper beams extendable for raising the respective beams and collapsible for lowering the respective beams, and a single force-transmitting element connected to both of the linkages and displaceable longitudinally in one direction for extending the linkages and in the opposite direction for collapsing the linkages. A single drive is connected between the frame and the force-transmitting element for simultaneously vertically displacing both beams.

German patent document 4,210,494 of A. Lattion describes such a scissor-linkage actuator of the above-described general type. It has a spring-loaded vertically effective abutment or bumper onto which the gripper beam comes to rest in its lowered position. This is intended to protect the scissor linkage in its most spread position, when it is least able to gain a mechanical advantage and is under maximum tension. This is an improvement on the system of above-mentioned German 1,785,217 where springs put the scissor arms under enormous stress, but requires a separate element to be provided for this spring support in the lower gripper-beam position. In addition there is a distinct possibility of a machine operator getting pinched between the beam and the element it is coming to rest on, so, to comply with worker-protection regulations, the device must be shielded, again increasing its cost.

OBJECTS OF THE INVENTION

It is therefore an object of the present invention to provide an improved scissor-linkage actuator for a bobbin changer.

Another object is the provision of such an improved scissor-linkage actuator for a bobbin changer which overcomes the above-given disadvantages, that is which provides spring-biased support for the gripper beam in its lower position, but also is simple, safe, and inexpensive.

SUMMARY OF THE INVENTION

In a ring-spinning machine having a frame and a spindle bank holding a row of bobbins, a bobbin-changing apparatus has according to the invention a gripper beam engageable with the bobbins of the spindle banks and movable between an upper and a lower position and a scissor linkage pivoted on the frame and on the gripper beam extendable for raising the beam and collapsible for lowering the beam. The linkage has according to the invention a pair of arms both of which have lower ends, one of which is long and has an upper end pivoted on the beam and the other of which is short and has an upper end pivoted on the long arm below the beam. One of the lower ends is pivoted on and fixed against longitudinal movement on an abutment. A guide is longitudinally displaceable on the frame and the other lower end is pivoted on it. A spring-biasing unit exerts torque on one of the ends of one of the arms for upwardly biasing the beam at least in the lower position of the beam.

The provision of such a spring-biasing unit has the advantage that the actuator for the scissor linkage and the bearings do not need to be as strong as in the prior-art bobbin changers. The reason for this is that the extreme stress that these parts are subjected to in the prior-art systems is largely eliminated.

According to the invention the torque exerted by the biasing unit increases as the gripper beam moves downward toward its lower position. The spring-biasing unit is braced between the long arm and the gripper beam or between one of the lower ends and the frame. In a particularly advantageous arrangement it is braced between the upper end of the short arm and the long arm below the gripper beam. More particularly the short-arm upper end and the long arm are interconnected at a pivot and the spring-biasing unit is effective at the pivot. The advantage of this is that a substantial spring travel can be employed since the angle between the two arms increases as they move downward.

The spring-biasing unit can be a leaf spring or a spiral torque spring. The torque spring has opposite ends each braced on respective ones of the arms. One of the arms has a spring stop that fits complementarily to a curvature of the spiral spring. More specifically this spring stop is only engaged by the respective spring end in an intermediate position between the upper and lower positions of the gripper beam and is out of operative torque-transmitting contact with the spring when the gripper beam is above the intermediate position. Normally the spring stop is on the long arm. A spiral spring can easily be encapsulated so that it presents no danger to machine operators.

In accordance with this invention upward force exerted by the spring-biasing unit on the gripper beam in the lower position is at least generally equal to the mass of the gripper beam. Thus in the lower position the beam is virtually floating. Thus even if the drive fails, the gripper beam will not drop suddenly, but will gently move into the lower position. The actuator or drive for the linkage can be relatively small, just enough to overcome friction and inertia.

A nonlocking drive can be used, such as a simple spindle/nut arrangement. More particularly the linkage further has according to the invention a longitudinally extending and rotatable spindle having a threaded portion engaged in the guide. Alternately it can have a longitudinally extending and rotatable spindle longitudinally fixed to the guide and threaded in the abutment.

BRIEF DESCRIPTION OF THE DRAWING

The above and other objects, features, and advantages will become more readily apparent from the following description, reference being made to the accompanying drawing in which:

FIG. 1*b* shows associated parts of the spinning machine;

SPECIFIC DESCRIPTION

Figure 1A:
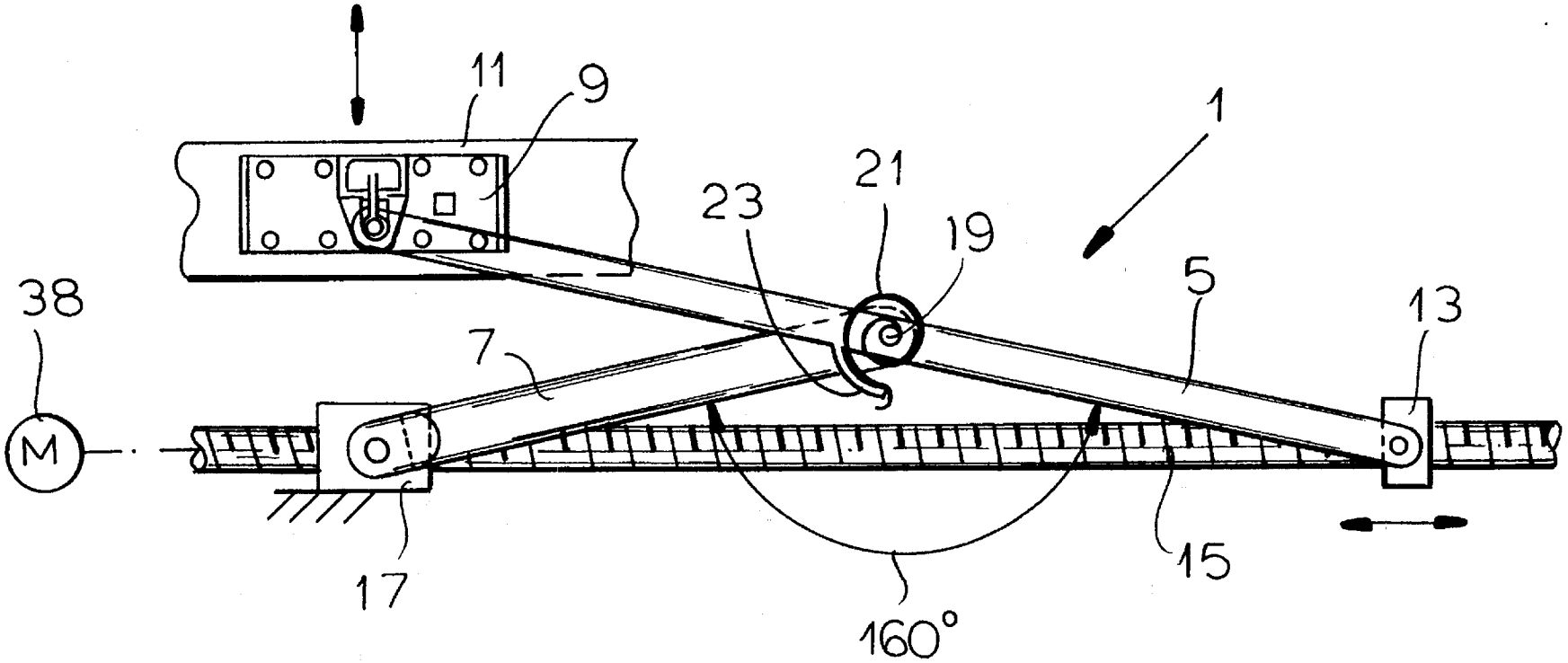
FIGS. 1*a*, 1*b*, and 1*c* are side views of the linkage according to the invention in the lower, intermediate, and upper positions, respectively.
Figure 1B:
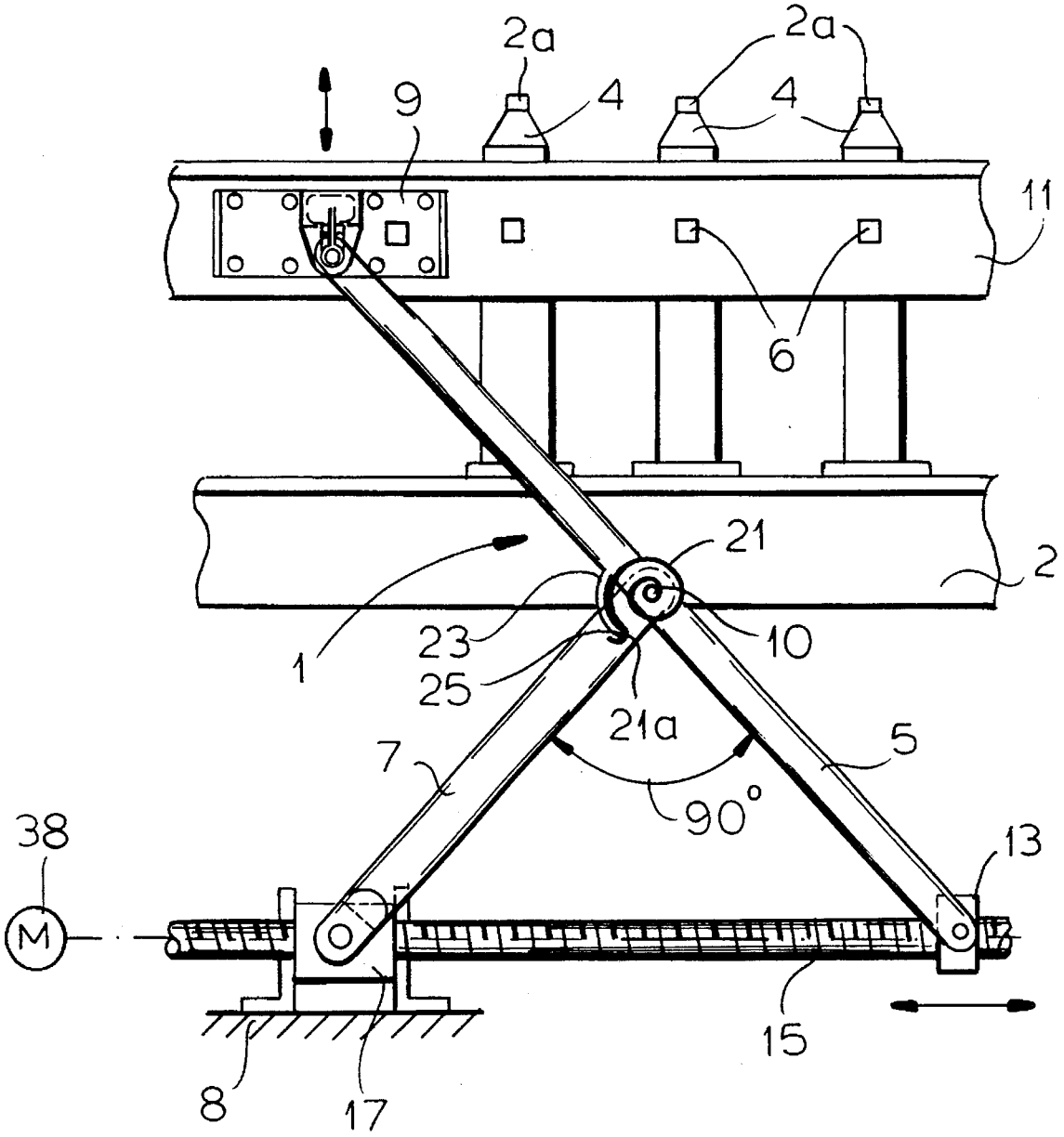

As seen in FIG. 1*b* a ring-spinning machine has a spindle bank 2 provided with rows of spindles 2*a* carrying respective finished cops 4. Unillustrated empty sleeves ready for mounting on the spindles may be on a transport apparatus at a level below the bank 2 as is well known in the art. Grippers 6 for grasping the cops 4 are arranged on a gripper beam 11 that is pivoted via a mounting flange 9 on a long arm 5 of a scissor linkage 1 which is pivoted at its other end in a guide or support 13. The support 13 is threaded on a spindle 15 which is axially fixed but rotatable on a machine frame 8. A further guide or support 17 in which the spindle 15 is slidable pivotally supports a lower end of a short arm 7 of the scissor linkage 1. The upper end of the short arm 7 is pivoted at 10 in the middle of the long arm 5. The pivot axes between the two arms 5 and 7 and between the arms 5 and 7 and the respective supports 13 and 17 are all horizontal, parallel, and perpendicular to a plane including the axis of the spindle 15 and on which the arms 5 and 7 lie. Normally means is provided for tipping the entire scissor linkage about the axis of the spindle 15. In practice two or more such linkages can be provided between a single such spindle 15 and a single such beam 11. In addition the spindle 15 can be formed with a screwthread directly engaged with the guide 13, or can have a recirculating ball screwthread-type connection therewith.

The scissor linkage 1 is shown in an intermediate position in FIG. 1*b*. Rotation of the spindle 15 in one direction will push the parts 13 and 17 apart and drop the linkage 1 downward into the lower position of FIG. 1*a*. Opposite rotation can bring it into the raised or upper position of FIG. 1*c*. As mentioned, this extension and retraction of the linkage 1 is accompanied by its pivoting inward and outward and by opening and closing of the grippers 6. The method of changing full cops against empty sleeves is known and is therefore not more closely described here.

Figure 1C:
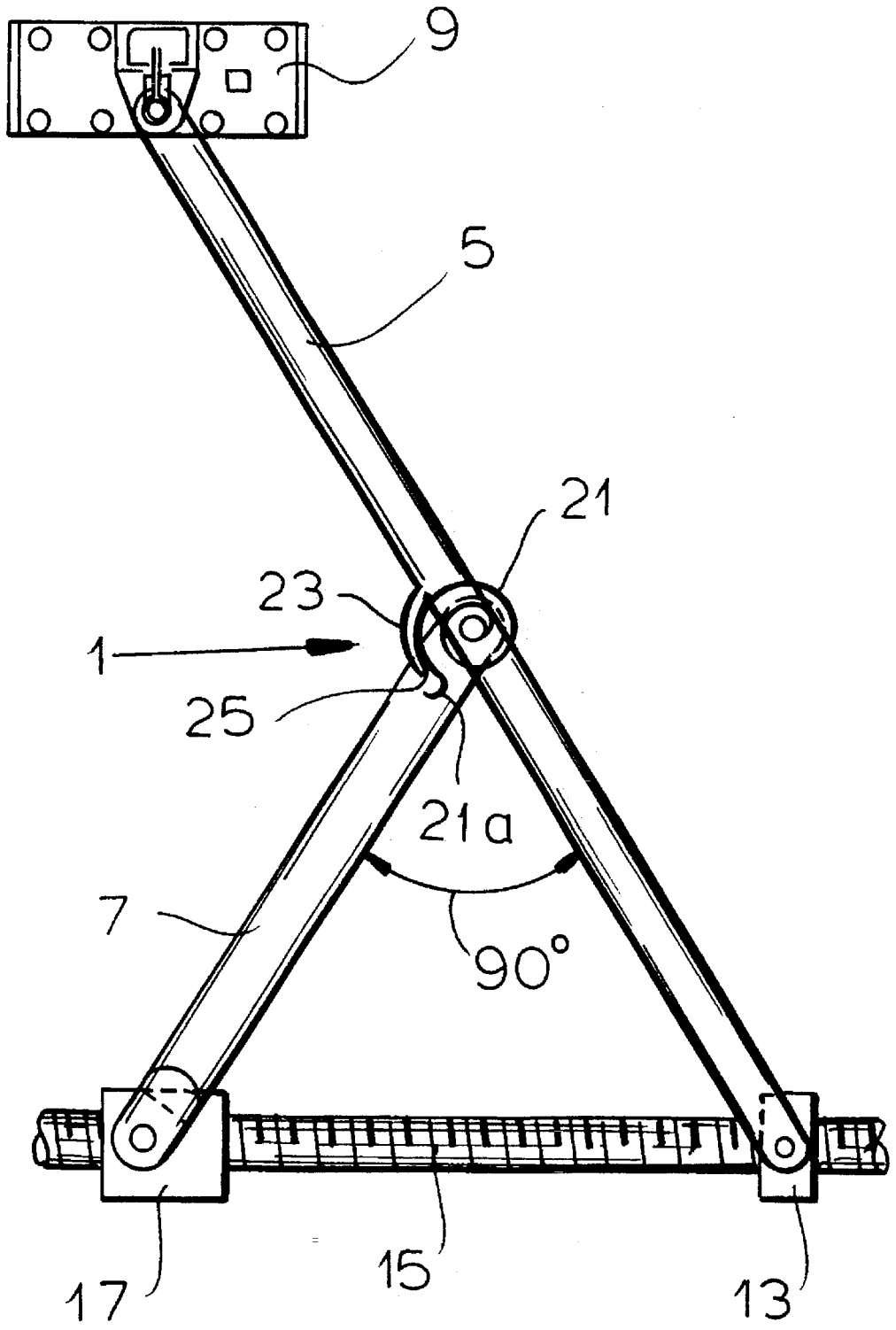

According to the invention a torsion spring 21 is provided at the pivot 10 between the arms 5 and 7. An inner end of the spring 21 is seated in a shaft 19 fixed in the arm 7 and projecting through and pivotally supporting the arm 5 like an axle. The other end rides on an arcuate spring stop 23 in which the outer turn of the spring 21 fits complementarily. In the upper position of the linkage 1 as shown in FIG. 1*c* with the arms 5 and 7 extending at less than 90° to each other, a bent-over end 21*a* of the spring 21 is out of contact with an end surface 25 of the arcuate stop 23. As the linkage 1 drops into the intermediate position of FIG. 1*b* with the arms 5 and 7 orthogonal contact is made and thence downward the spiral spring 21 applies a force moment M tending to extend or close the linkage 1, that is raise the beam 11. Normally the upward force effective on the beam 11 by the spring 21 is enough to make it float in the lower position, that is little stress is applied at the parts 13 and 17 in this position. On the other hand in the upper position of FIG. 1*c* the entire mass of the linkage 1 and what it is carrying is born by the parts 13 and 17 so that sleeves or cops are set on the spindle bank of a ring-spinning machine or on a lower collecting beam with only the weight of the beam, of the sleeves or cops, and the linkage. It is of course also possible to eliminate the free travel or lost motion before the spring 21 is effective but then it is necessary to take care that the drive can, when opening the linkage 1 to drop the doffer beam 11, exert sufficient force to properly mount the sleeves or cops on their spindles.

Figure 2A:
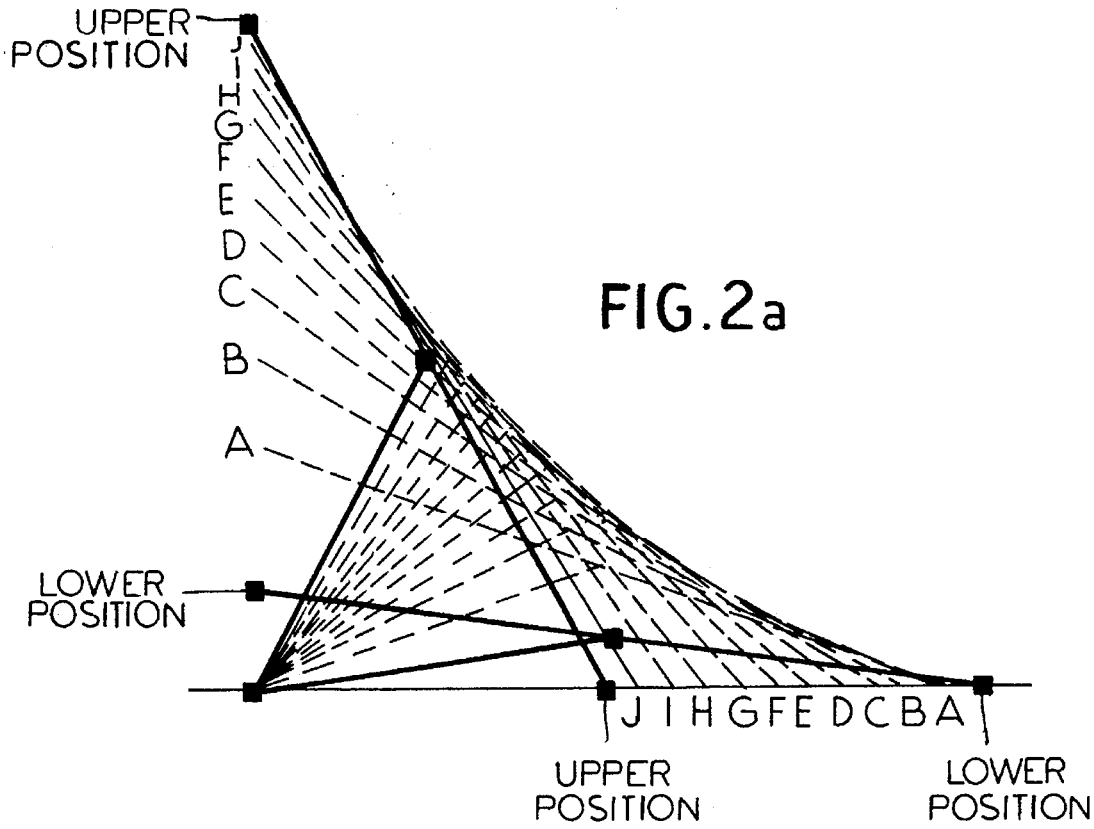
FIGS. 2*a* and 2*b* are graphs illustrating the present invention.
Figure 2B:
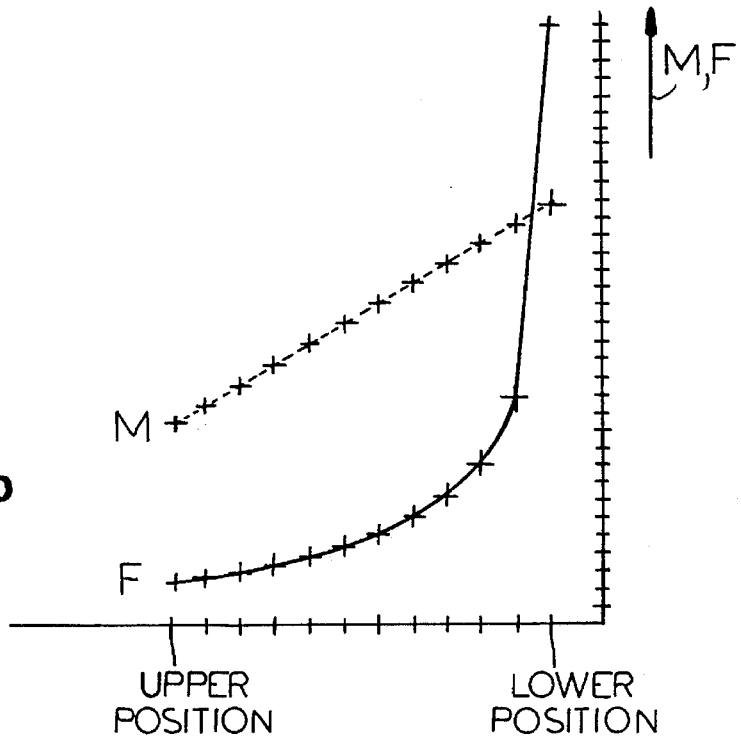

The moment M necessary for this is shown by the straight curve in FIG. 2*b* which represents the moment transmitted by the spiral spring 21 to the scissor arms 5 and 7 and necessary to maintain the linkage floating in the respective position. In FIG. 2*b* the abscissa shows the twelve positions and the ordinate the force F that the spring must bring to bear to maintain the linkage floating in the various positions. This is calculated such that horizontal force that is exerted on the parts 13 and 17 is eliminated. The path of this horizontal force F is shown by the hyperbolic curve of FIG. 2*b*. FIG. 2*a* shows the corresponding positions of the linkage with intermediate positions A through J.

Figure 3A:
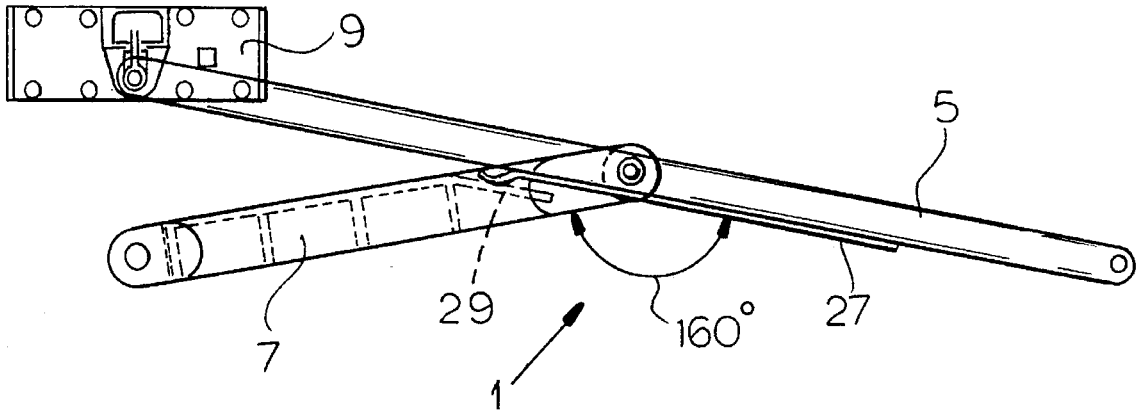
FIGS. 3*a* and 3*b* are side views of another linkage in the lower and intermediate positions, respectively.
Figure 3B:
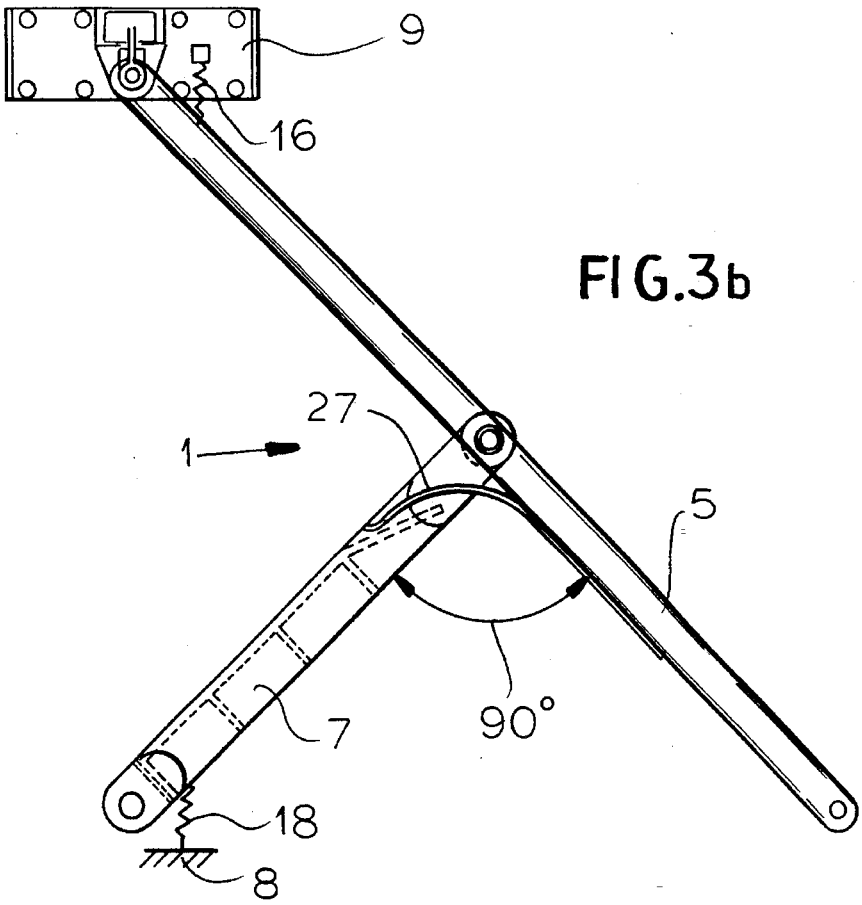

FIGS. 3*a* and 3*b* shows a similar system but where the spiral spring is replaced with a leaf spring 27 bolted to the long arm 5 and engageable with an abutment web 29 of the beam 7. In FIG. 3*b* the spring 27 is shown in its relaxed position. The exact spring constant for the leaf spring 27 can be difficult to get, so that normally this spring 27 is made of a stack of thin springs, allowing the user to adjust the spring strength. Alternately the spring 27 can be formed of a material that has a predetermined thickness dependent on length, that is that decreases in thickness and width toward its outer end.

FIG. 3*b* also shows how a spring shown schematically at 16 can be braced between the flange 9 and the arm 5 and a spring 18 can be braced between the arm 7 and the frame 8 16 and 18 can assist the spring 27.

We claim:

1. In a ring-spinning machine having a frame and a spindle bank holding a row of bobbins, a bobbin-changing apparatus comprising:

a gripper beam engageable with the bobbins of the spindle banks and movable between an upper and a lower position;

a scissor linkage pivoted on the frame and on the gripper beam extendable for raising the beam and collapsible for lowering the beam, the linkage comprising a pair of arms both of which have lower ends, one of which is long and has an upper end pivoted on the beam, and the other of which is short and has an upper end pivoted on the long arm below the beam, an abutment on which one of the lower ends is pivoted and against which the one lower end is fixed against longitudinal movement, and a guide longitudinally displaceable on the frame and on which the other lower end is pivoted; and biasing means operatively engageable with one of the ends of one of the arms at least in the lower position of the beam for exerting torque on the one end of the one arm and upwardly biasing the beam at least in the lower position of the beam.

2. The bobbin-changing apparatus defined in claim 1 wherein the torque exerted by the biasing means increases as the gripper beam moves downward toward its lower position.

3. The bobbin-changing apparatus defined in claim 1 wherein the biasing means is braced between the long arm and the gripper beam.

4. The bobbin-changing apparatus defined in claim 1 wherein the biasing means is braced between one of the lower ends and the frame.

5. The bobbin-changing apparatus defined in claim 1 wherein the biasing means is braced between the upper end of the short arm and the long arm below the gripper beam.

6. The bobbin-changing apparatus defined in claim 5 wherein the short-arm upper end and the long arm are interconnected at a pivot and the biasing means is effective at the pivot.

7. The bobbin-changing apparatus defined in claim 6 wherein the biasing means is a leaf spring.

8. The bobbin-changing apparatus defined in claim 6 wherein the biasing means is a spiral torque spring.

9. The bobbin-changing apparatus defined in claim 8 wherein the torque spring has opposite ends each braced on respective ones of the arms.

10. The bobbin-changing apparatus defined in claim 8 wherein one of the arms has a spring stop that fits complementarily to a curvature of the spiral spring.

11. The bobbin-changing apparatus defined in claim 8 wherein one of the arms has a spring stop that is only engaged by the respective spring end in an intermediate position between the upper and lower positions of the gripper beam and is out of operative torque-transmitting contact with the spring when the gripper beam is above the intermediate position.

12. The bobbin-changing apparatus defined in claim 11 wherein the spring stop is on the long arm.

13. The bobbin-changing apparatus defined in claim 1 wherein upward force exerted by the biasing means on the gripper beam in the lower position is at least generally equal to the mass of the gripper beam.

14. The bobbin-changing apparatus defined in claim 1, further comprising a longitudinally extending and rotatable spindle having a threaded portion engaged in the guide.

* * * * *